United States Patent [19]

Mirand et al.

[11] Patent Number: 4,925,397

[45] Date of Patent: May 15, 1990

[54] LATCH MECHANISM FOR COMPUTER MODULE

[75] Inventors: Mauricio Mirand, Lakewood; Robert E. Gaskill, Santa Ana, both of Calif.

[73] Assignee: American International Devices, Inc., Los Angeles, Calif.

[21] Appl. No.: 384,267

[22] Filed: Jul. 24, 1989

[51] Int. Cl.[5] ..... H01R 13/629

[52] U.S. Cl. ..... 439/353; 361/415; 439/328; 439/377

[58] Field of Search ....., ..... 439/59, 61, 64, 325, 439/327, 328, 377, 554, 326, 350, 352, 353; 361/413, 415; 211/41

[56] References Cited

U.S. PATENT DOCUMENTS 3,245,546 9/1964 Stuhler ..... 211/41

4,133,022 1/1979 Moose et al. ..... 439/59

*Primary Examiner*—Eugene F. Desmond

*Assistant Examiner*—Walter G. Hanchuk

*Attorney, Agent, or Firm*—Roy A. Ekstrand

[57] ABSTRACT

A latching mechanism for computer modules or the like includes a pair of generally L-shaped slide members having defined therein internal grooves for receiving the edge portions of the printed circuit boards of the computer modules. Overlapping tabs secure the slide members upon the edge portions of the circuit board and a pair of opposed springs are compressively captivated between the slide members and the circuit board to urge the slide members outwardly. Each slide member defines a tapered lock tab which cooperates with corresponding recesses within the slide connectors receiving the computer module and providing a locking or latch mechanism.

7 Claims, 3 Drawing Sheets

LATCH MECHANISM FOR COMPUTER MODULE

FIELD OF THE INVENTION

This invention relates generally to computer systems and particularly to plug in board modules used in connection therewith.

BACKGROUND OF THE INVENTION

Early in the commercial development of computer systems it became apparent to computer designers that, regardless of the size and computing power of their computer systems, the need for easy repair, flexibility and expansion capability would be best served by providing computer systems having a plurality of plug in computer modules. There followed substantial development on the part of computer designers directed at the most efficient and effective plug in and connecting mechanism for use in computing systems. In certain types of computers, such as the AS/400 series computers manufactured by International Business Machines Corporation, a plurality of plug in modules are supported in a horizontal array of vertically oriented modules generally accessible from a common computer panel. A plurality of slot-type connectors are arranged in opposed vertically aligned pairs across the horizontal plug in array which receive the plug in modules. Because of the slot-type construction of the connectors above and below the plug in modules, the modules are generally provided with a pair of extending edge portions on either side which are received within the slots of the connectors. The extending board portions support a plurality of connection paths which cooperate with connection terminals within the slot-type connectors to establish electrical interconnections between the plug in modules and the remainder of the computing system. Each of the slot-type connectors includes a latching or lock mechanism to captivate the modules within the slot connectors. In addition, each module includes a second locking or latch mechanism which cooperates with the connectors to further captivate and secure the computer module within the connector array. One of the most common locking mechanisms for such computer modules is marketed by International Business Machines Corporation which provides an extended multiply curved spring wire member which spans the width of the computer module and terminates on either end in extending metal tines which are received within recesses provided in the slide connector.

While the prior art locking mechanisms for such slide in supported computer modules have performed their locking function in a relatively satisfactory manner, they tend to be expensive and are often difficult to manipulate in module insertion and removal operations.

As a result, there remains therefore a need in the art for an improved locking mechanism for use in securing computer modules which are utilized in slide in type supporting and connecting arrangements.

SUMMARY OF THE INVENTION

Accordingly, it is a general object of the present invention to provide an improved locking mechanism for a computer module. It is a more particular object of the present invention to provide an improved latch mechanism for computer modules which cooperates efficiently and effectively with the presently existing slot-type connector support systems.

In accordance with the present invention, there is provided for use in securing a circuit module having opposed side edges and a front edge in a seated position within a pair of opposed support members having support slots therein, latch means comprising: a first elongated slide member defining a first channel portion having a first internal channel extending its entire length and terminating at one end in an extending first locking tab and an extending first grip portion at the other end; a second elongated slide member defining a second channel portion having a second internal channel extending its entire length and terminating at one end in an extending second locking tab and an extending second grip portion at the other end; guide means for supporting the first and second slide members upon the front edge of the circuit module such that the front edge thereof is received within the first and second internal channels in a sliding engagement and the first and second locking tabs extend outwardly in opposed directions; and spring means coupled to the first and second grip portions for urging the first and second slide members apart urging the first and second locking tabs into the opposed support slots.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
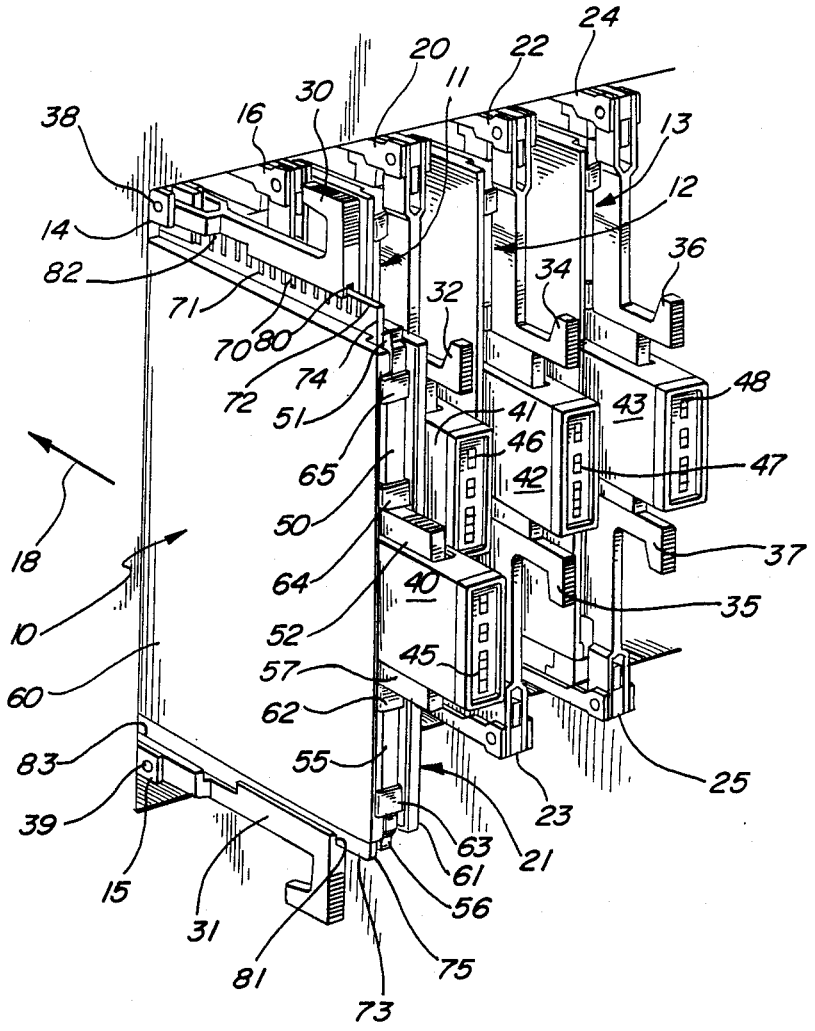
FIG. 1 sets forth a perspective view of a plurality of computer circuit modules having the present invention latch mechanisms.

FIG. 1 sets forth a perspective view of a plurality of computer circuit modules supported in a parallel array and in accordance with typical computer fabrication techniques to which the present invention pertains. A plurality of computer modules 10, 11, 12 and 13 are supported in a parallel vertical array by a corresponding plurality of slide connectors. Specifically, module 10 is supported by a pair of slide connectors 14 and 15 while modules 11, 12 and 13 are supported at their respective upper edges by slide connectors 20, 22 and 24 respectively and their bottom edges by connectors 21 (not seen) 23 and 25 respectively. It should be noted that module 10 is shown partially inserted within slide connectors 14 and 15 while modules 11, 12 and 13 are shown in their fully seated positions within their respective slide connectors. FIG. 1 also shows a vacant or empty position between modules 10 and 11. Accordingly, it should be understood that a pair of slide connectors 16 and 17 (the latter not seen) are supported in a similar manner to the remaining slide connectors and are thus capable of receiving an additional module in the same manner as shown for modules 10 through 13.

In accordance with conventional fabrication techniques, slide connectors 14 and 15 include pivotal locking levers 30 and 31 respectively. Lever 30 is pivotally supported upon slide 14 by a pivot pin 38 while locking lever 31 is pivotally supported on connector 15 by a pivot pin 39. In the position shown in FIG. 1, levers 30 and 31 are pivoted to the open or extended position suitable for receiving the inserting of computer module 10. In contrast, it will be noted that slide connectors 20 through 25 support a corresponding plurality of locking levers 32 through 37 respectively. It will be apparent that slide connector 21 and lever 33 are not visible in FIG. 1 due to the extension of module 10. However, it will be understood by those skilled in the art that slide connector 21 and lever 33 are identical to the remaining slide connectors and locking levers shown in FIG. 1. Computer module 10 defines a generally planar circuit board 70 having an upper edge 72 and a lower edge 73 which define generally parallel support edges for module 10. In accordance with conventional fabrication techniques, circuit board 70 defines a plurality of connection pads 71 arranged in a parallel arrangement near edge 72. It will be understood by those skilled in the art that in the fully seated position connection pads 71 provide electrical connections to a plurality of corresponding connecting terminals (not shown) within slide connector 14. Correspondingly, printed circuit board 70 may support a similar plurality of connecting paths proximate to edge 73 in the event additional circuit connections are required. In such case, it would be similarly understood that slide connector 15 includes a corresponding plurality of connecting terminals to provide appropriate electrical connection to circuit board 70.

Circuit module 10 further includes a pair of generally planar cover plates 60 and 61 supported in a spaced apart arrangement from circuit board 70 on either side thereof to provide protective covering for the circuit components and electrical connections (not shown) which are typically found on circuit board 70. In addition, cover plates 60 and 61 define a plurality of guide tabs 62, 63, 64 and 65 which extend or span the spacing between cover plates 60 and 61. A generally rectangular extension 40 extends outwardly from module 10 and terminates in a plurality of indicators 45. Indicators 45 are electrically coupled to the circuit components within circuit module 10 (not shown) and are selectively illuminated to provide various status or operational indications to the user. It should be understood that the structures of modules 11, 12 and 13 are virtually identical to module 10. Accordingly, modules 11, 12 and 13 define respective extensions 41, 42 and 43 which in turn support pluralities of status indicators 46, 47 and 48 respectively.

In accordance with their intended use, slide connectors 14 and 15 define elongated slots 82 and 83 respectively which extend the length of the slide connector bodies. Similarly, locking levers 30 and 31 define respective slots 80 and 81 which, in the open or extended position shown for levers 30 and 31, are aligned with slots 82 and 83 respectively. Thus with levers 30 and 31 in the open position shown in FIG. 1, circuit module 10 is guided into slots 82 and 83 of slide connectors 14 and 15 respectively by the cooperation of edges 72 and 73 of circuit board 70 with slots 80 and 81 of levers 30 and 31 respectively. As circuit module 10 is pushed into slide connectors 14 and 15 beyond the position shown in FIG. 1 in the direction indicated by arrow 18, slots 82 and 83 receive edges 72 and 73 respectively of circuit board 70.

In accordance with an important aspect of the present invention, computer module 10 supports a pair of locking slide members 50 and 55 on either side of extension 40. In accordance with the present invention and as set forth below in greater detail, slide 50 defines a generally L-shaped member terminating at one end in a lock tab 51 and at the other end in a grip tab 52. Lock tab 51 defines an internal channel 53 (seen in FIG. 3) which extends the length of slide 50 and which receives front edge 74 of circuit board 70. Slide 50 further defines an orthogonal grip tab 52 extending along extension 40 and slidably received thereon in accordance with the structure set forth in detail in FIG. 3. Slide 50 is maintained in the position shown in FIG. 1 by the overlap of tabs 64 and 65. Similarly, a slide member 55 identical to slide 50 defines a generally L-shaped member having an internal channel 54 (seen in FIG. 3) which receives front edge 75 of printed circuit board 70 in a sliding engagement. Slide 55 further includes an orthogonal grip tab 57 extending along the lower portion of extension 40 and slidably engaged thereto in accordance with the structure set forth in FIG. 3. In similar fashion to the support of slide 50, slide 55 is maintained in the position shown in FIG. 1 by the overlap of tabs 62 and 63. Slide 50 terminates in an outwardly extending lock tab 51 while slide 55 terminates in an outwardly extending lock tab 56. In accordance with an important aspect of the present invention and as is better seen in FIG. 3, a pair of springs 66 and 67 are coupled to grip tabs 52 and 57 respectively to urge slides 50 and 55 outwardly to the extended positions shown in FIG. 1 in which lock tabs 51 and 56 extend beyond cover plates 60 and 61.

With module 10 positioned as shown in FIG. 1, the insertion of module 10 within slide connectors 14 and 15 is completed by pushing module 10 inwardly in the direction indicated by arrow 18 until module 10 is seated within slide connectors 14 and 15. During the insertion of module 10 within slide connectors 14 and 15, and in accordance with an important aspect of the present invention, lock tabs 51 and 56 are snapped into a pair of recesses 26 and 27 (seen in FIG. 2) which securely lock module 10 within its seated position. Thereafter, the closure of locking levers 30 and 31 is accomplished by pivoting them inwardly about pivots 38 and 39 respectively until levers 30 and 31 assume the positions shown for the remaining locking levers in FIG. 1. In the event circuit module 10 is to be removed from slide connectors 14 and 15, the above procedure is reversed in that locking levers 30 and 31 are pivoted about pivot pins 38 and 39 to the extended positions shown in FIG. 1. Thereafter, the user simply grasps grip tabs 52 and 57 and applies a squeezing force therebetween which overcomes springs 66 and 67 and moves slide members 50 and 55 inwardly toward each other which in turn withdraws lock tabs 51 and 56 from their respective recesses within slide connectors 14 and 15. Thereafter, module 10 is removed by simply withdrawing it.

It will be apparent to those skilled in the art that the latch mechanism provided by slides 50 and 55 is convenient, easy to use and requires a minimum of cooperating parts. In addition, examination of FIG. 1 also shows that the placement of slides 50 and 55 is selected to avoid occupying any of the space between the computer modules and thus does not interfere with the structure or thickness desired of the computer modules.

Figure 2:
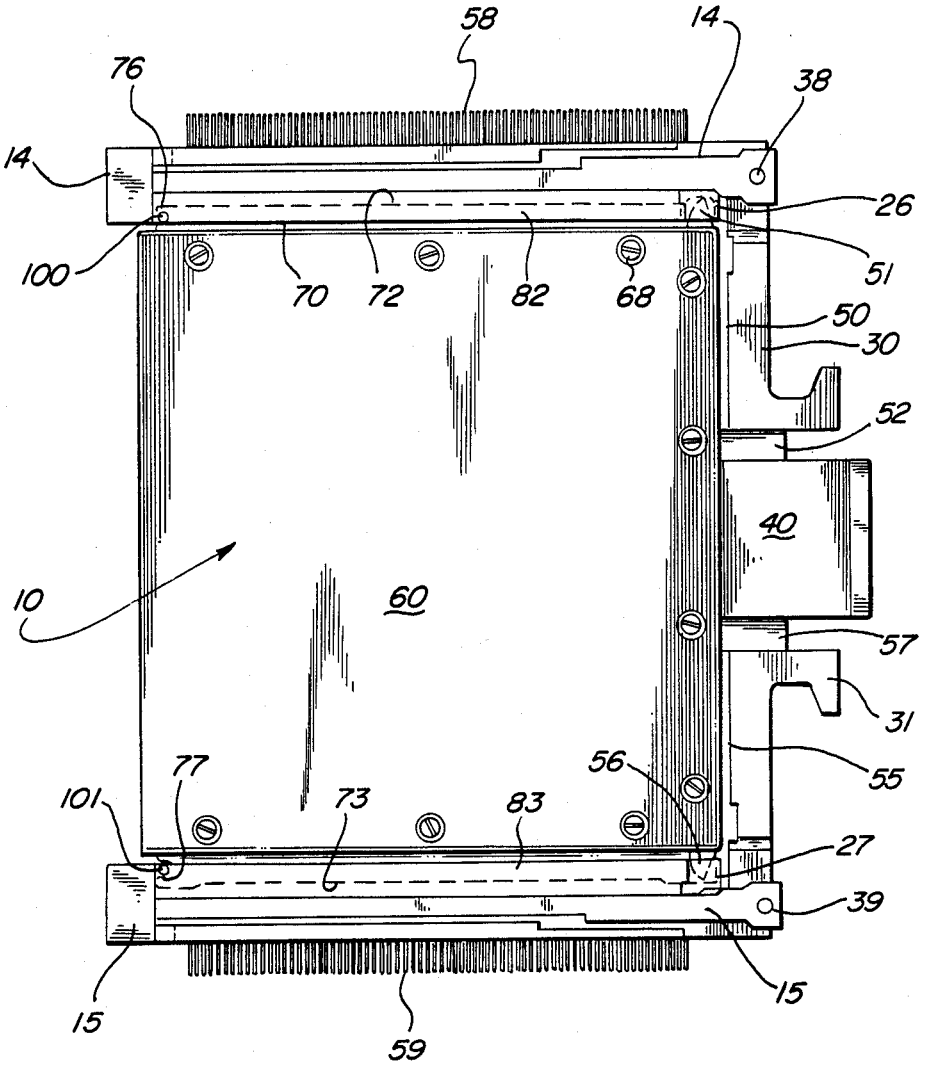
FIG. 2 sets forth a side elevation view of a typical computer module having the present invention latch mechanism.

FIG. 2 sets forth a simplified side elevation view of module 10 in its seated or nested position within the array shown in FIG. 1. For purposes of clarity and simplicity, the remaining structure which surrounds and supports slide connectors 14 and 15 in the host computer (not shown) has been omitted in FIG. 2. Slide connectors 14 and 15 are supported in a parallel arrangement by means not shown such that a plurality of pins 58 and 59 extending from slide connectors 14 and 15 provide electrical connections between the host computer (not shown) and the circuit components of module 10 (also not shown). Locking levers 30 and 31 of slide connectors 14 and 15 respectively are shown in the closed positions which secure computer module 10 within slide connectors 14 and 15. As described above, computer module 10 includes a circuit board 70 having a pair of edges 72 and 73 on either side thereof. Module 10 further includes a cover plate 60 and defines an outwardly extending extension 40. Circuit board 70 further defines a pair of notches 76 and 77 proximate to edges 72 and 73. A pair of movable slide members 50 and 55 are supported upon module 10 by means set forth below in greater detail. As described above, slides 50 and 55 define respective outwardly extending lock tabs 51 and 56 and orthogonal grip tabs 52 and 57 to form generally L-shaped members. Slide 14 defines a slot 82 extending the length of slide connector 14. Connector 14 further defines a recess 26 and a mounting pin 100. Recess 26 receives lock tab 51 of slide 50 in accordance with the present invention latch mechanism set forth below in greater detail. Pin 100 extends across slot 82 and is received within notch 76 of circuit board 70 when module 10 is seated within slide connector 14. Similarly, slide connector 15 defines a recess 27 which receives lock tab 56 of slide 55 and an elongated slot 83 which receives edge 73 of circuit board 70. Slide connector 15 further includes a mounting pin 101 which extends across slot 83 and is received within notch 77 of circuit board 70 when module 10 is in its seated position. Thus in the position shown in FIG. 2, the spring force produced by springs 66 and 67 (seen in FIG. 3) operative upon slides 50 and 55 secures module 10 within slide connectors 14 and 15 by maintaining the positions of locking tabs 51 and 56 within recesses 26 and 27 respectively. As is set forth below in greater detail, lock tabs 51 and 56 further cooperate with recesses 26 and 27 to provide a securing force upon module 10 which urges notches 76 and 77 against pins 100 and 101 respectively to further secure module 10 in its seated position. In accordance with conventional fabrication techniques, module 10 further includes a plurality of fasteners 68 which are spaced about the periphery of module 10 to secure cover plates 60 and 61 (the latter seen in FIG. 1) on either side of circuit board 70.

Figure 3:
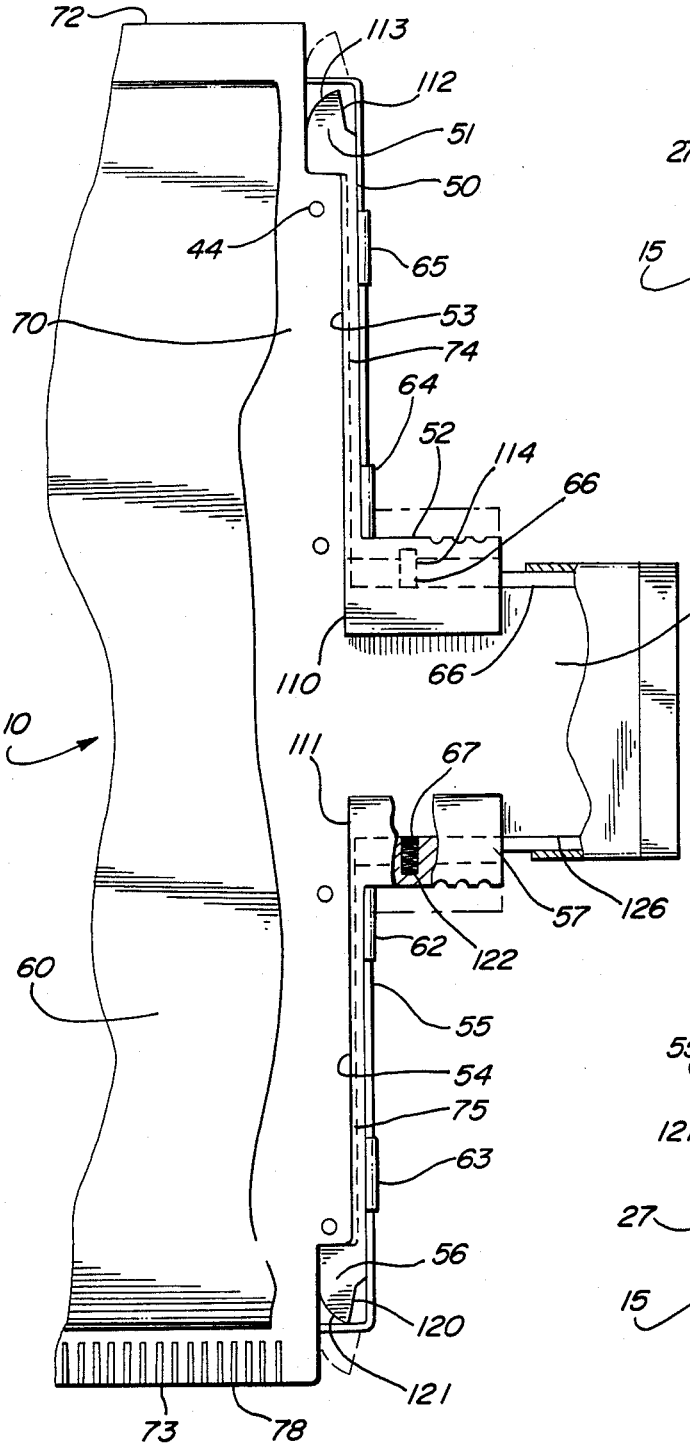
FIG. 3 is a partial section view of a typical computer module supporting the present invention latch mechanism.

FIG. 3 sets forth a partially sectioned view of module 10 supporting the present invention latch mechanism. Accordingly, module 10 includes a planar circuit board 70 having an upper edge 72 and a lower edge 73. Circuit board 70 further defines a board extension 69 having a pair of extension edges 125 and 126 on either side thereof. Circuit board 70 further defines a front edge 74 extending from extension edge 125 and a front edge 75 extending from extension edge 126.

In accordance with the present invention, a pair of slide members 50 and 55 are supported upon circuit board 70. Slide 50 defines a generally L-shaped member having an internal channel 53 extending substantially the length thereof. Slide 50 further defines a grip tab 52 which in turn defines a slot 110 extending the length thereof. A bore 114 is defined within grip tab 52. A spring 66 is captivated within bore 114 and is compressed between bore 114 and extension edge 125 to provide a spring force which urges slide 50 outwardly from board extension 69. Channel 53 receives front edge 74 of circuit board 70 and a pair of tabs 65 and 64 extend between cover plates 60 and 61 to captivate slide 50 against circuit board 70 and board extension 69. Slide 50 further defines an outwardly extending lock tab 51 which in turn defines a generally tapered member having an angled camming surface 112 and a curved surface 113.

As mentioned above, slide 55 is identical to slide 50 and comprises a generally L-shaped member having an internal channel 54 receiving front edge 75 and a perpendicular grip tab member 57. Grip tab 57 defines a slot 111 receiving board extension 69 and a bore 122. The latter supports a spring 67 which is compressed between bore 122 and extension edge 126 of board extension 69 to urge slide 55 outwardly therefrom. A pair of tabs 62 and 63 extend between cover plates 60 and 61 to captivate slide 55 against front edge 75 and extension edge 126. By way of further similarity, slide 55 includes an outwardly extending lock tab 56 comprising a generally tapered structure having an angled camming surface 120 and a curved surface 121.

In accordance with the invention, grip slides 50 and 55 may be squeezed together or drawn inwardly to retract lock tabs 51 and 56 to the positions shown in solid line representation in FIG. 3. When in such position, lock tabs 51 and 56 are completely withdrawn from recesses 26 and 27 (seen in FIG. 2) of slide connectors 14 and 15. When lock tabs 51 and 56 are so withdrawn, module 10 may be removed from connectors 14 and 15. With the release of grip tabs 52 and 57, the spring forces provided by springs 66 and 67 urge slides 50 and 55 outwardly to the extended position shown in dashed line representation in FIG. 3. When so extended, lock tabs 51 and 56 extend into recesses 26 and 27 respectively of slide connectors 14 and 15 respectively (seen in FIG. 2). Thus the present invention latching mechanism is completely operable by simply squeezing grip tabs 52 and 57 inwardly.

Figure 4A:
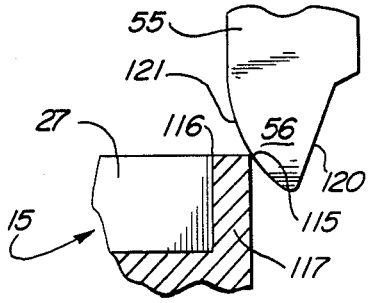
FIGS. 4A and 4B and 4C set forth partial section views of a portion of the present invention latch mechanism.
Figure 4B:
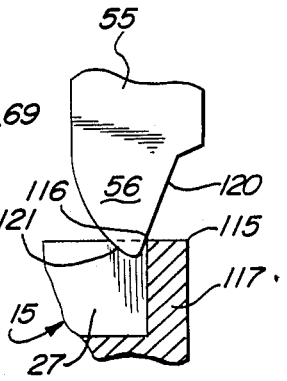
Figure 4C:
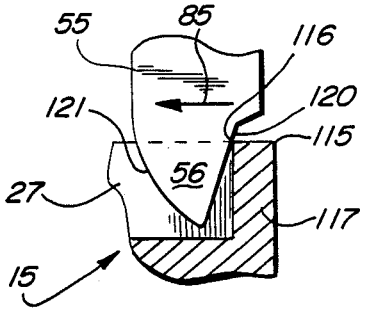

FIGS. 4A, 4B and 4C set forth the sequential operation of the lock tab portion of the present invention latching system as module 10 is seated within slide connectors 14 and 15. Specifically, FIG. 4A sets forth slide 55 having lock tab 56 extending therefrom. Lock tab 56 includes an angled camming surface 120 and a curved surface 121. Connector 15 defines a recess 27 having a front wall 117 which in turn defines a front edge 115 and a rear edge 116. In the position shown in FIG. 4A, module 10 is moving in the direction indicated by arrow 85 which in turn places slide 55 in the position shown in FIG. 4A causing edge 115 to abut curved surface 121. The force upon module 10 and thereby slide 55 causes surface 121 to move across edge 115 and force slide 55 upwardly to the position shown in FIG. 4A. With the continued movement of module 10 in the direction of arrow 85, slide 55 is forced upwardly by the cooperation of curve 121 and edge 115 until lock tab 56 clears wall 117.

FIG. 4B sets forth the relative positions of slide 55 and recess 27 of connector 15 as module 10 is further inserted within connector 15. As slide 55 moves across wall 117, the spring forces described above operative upon slide 55 urge lock tab 56 downwardly into recess 27. In the position shown in FIG. 4B, camming surface 120 of lock tab 56 is forced against edge 116 of wall 117. The downward spring force upon slide 55 described above produces a camming force between edge 116 and camming surface 120 which tends to further urge module 10 in the direction indicated by arrow 85.

FIG. 4C sets forth the position of slide 55 at the completion of the insertion of module 10 into connector 15. In the position shown, lock tab 56 of slide 55 extends into recess 27 of connector 15. It should be noted that camming surface 120 of lock tab 56 continues to be forced against edge 116 of wall 117 by the above-described spring forces. The angle of camming surface 120 causes the spring force against slide 55 to produce a residual or retaining force in the direction indicated by arrow 85 which is operative against module 10. Thus the spring force of spring 67 upon slide 55 produces a securing force for module 10 within slide connector 15. It should be apparent to those skilled in the art that the operation described for lock tab 56 within connector 15 is simultaneously occurring between lock tab 51 and recess 26 causing an identical function between slide 50 and slide connector 14 and produce an identical securing force against module 10.

Thus in accordance with an important aspect of the present invention, slides 50 and 55 need not be manipulated as module 10 is inserted within slide connectors 14 and 15. In addition, slides 50 and 55 are simply squeezed together to provide ready and simple removal of module 10 from slide connectors 14 and 15. Finally, the function of the camming surfaces upon the lock tabs of the present invention latching system provides a residual spring force which further secures the module within the supporting slide connectors.

What has been shown is a simple, efficient and low cost latching mechanism for use in securing a computer module or similar circuit board within a pair of opposed slide connectors. The system utilizes a minimum number of additional parts and maybe manufactured from relatively inexpensive molded plastic components. Finally, the latching system shown is entirely in alignment with the circuit board and therefore does not increase the required thickness or heighth of the module and maximizes therefor the use of interboard spacing within the module array.

That which is claimed is:

1. For use in securing a circuit module having opposed side edges and a front edge in a seated position within a pair of opposed support members having support slots therein, latch means comprising:

a first elongated slide member defining a first channel portion having a first internal channel extending its entire length and terminating at one end in an extending first locking tab and an extending first grip portion at the other end;

a second elongated slide member defining a second channel portion having a second internal channel extending its entire length and terminating at one end in an extending second locking tab and an extending second grip portion at the other end;

guide means for supporting said first and second slide members upon the front edge of the circuit module such that the front edge thereof is received within said first and second internal channels in a sliding engagement and said first and second locking tabs extend outwardly in opposed directions; and spring means coupled to said first and second grip portions for urging said first and second slide members apart urging said first and second locking tabs into the opposed support slots.

2. Latch means as set forth in claim 1 wherein the support slots each define a front edge and wherein said first and second locking tabs define respective first and second angled camming surfaces which cooperate with the front edges of the support slots to urge the circuit module toward its seated position.

3. Latch means as set forth in claim 2 wherein the front edge of the circuit module defines an extension having a pair of opposed generally parallel extension edges and wherein said first and second grip portions define first and second slots respectively which receive the extension edges of said extension in sliding engagements.

4. Latch means as set forth in claim 3 wherein said spring means include first and second springs compressively captivated within said first and second slots respectively against the extension edges of the extension.

5. Latch means as set forth in claim 4 wherein the extension edges of the circuit module extension are mutually perpendicular to its front edge and wherein said first and second grip portions are perpendicular to said first and second channel portions respectively.

6. Latch means as set forth in claim 5 wherein the support members include outer edges transverse to the support slots and wherein said first and second locking tabs define first and second convex curved surfaces cooperating with the outer edges of the support members to force said first and second slide members inwardly as the circuit module is forced toward its seated position.

7. For use in securing a circuit module having a generally rectangular circuit board defining a pair of parallel side edges and a front edge and a generally rectangular extension extending outwardly from the front edge, a module latch comprising:

a first generally L-shaped slide member having an outwardly facing first L-shaped channel slidably receiving a portion of the front edge and the rectangular extension of the circuit board and having an end portion terminating in a first tapered lock tab;

a second generally L-shaped slide member having an outwardly facing second L-shaped channel slidably receiving a portion of the front edge and the rectangular extension of the circuit board and having an end portion terminating in a second tapered lock tab;

first and second guide tabs captivating said first and second slide members against the corners formed between the front edge of the circuit board and the rectangular extension; and first and second springs compressively captivated between said first and second slide members and the rectangular extension of the circuit board to urge said slide members outwardly.

* * * * *